US005096067A

United States Patent [19]

Tutamune et al.

[11] Patent Number: 5,096,067

[45] Date of Patent: Mar. 17, 1992

[54] APPARATUS FOR HANDLING SHEETS OF PAPER

[75] Inventors: Hirotaka Tutamune, Nakajo; Yasuo Shiragai, Niigata; Yoshiaki Karino; Yasuyuki Wakasa, both of Nakajo, all of Japan

[73] Assignee: Hitachi, Ltd., Tokyo, Japan

[21] Appl. No.: 420,946

[22] Filed: Oct. 13, 1989

Related U.S. Application Data

[62] Division of Ser. No. 874,131, Jun. 13, 1986, Pat. No. 4,884,698.

[30] Foreign Application Priority Data

Jun. 17, 1985 [JP] Japan ..... 64-129822
Jul. 5, 1985 [JP] Japan ..... 64-146505
Sep. 10, 1985 [JP] Japan ..... 64-198433

[51] Int. Cl.[5] ..... B07C 5/38; G07D 7/00

[52] U.S. Cl. ..... 209/551; 209/534; 235/379; 377/8; 902/12

[58] Field of Search ..... 209/534, 551; 377/8; 235/379

[56] References Cited

U.S. PATENT DOCUMENTS

| | | | |
|---|---|---|---|
| 3,168,644 | 2/1965 | Richardson et al. | 377/8 |
| 3,176,859 | 4/1965 | Prager | 414/114 |
| 3,759,382 | 9/1973 | Walkley et al. | 209/551 X |
| 3,868,044 | 2/1975 | Abe et al. | 271/9 X |
| 3,966,059 | 6/1976 | Sase | 414/114 |
| 4,017,004 | 4/1977 | Onoe et al. | 271/9 X |
| 4,262,817 | 4/1981 | Fish | 271/9 X |
| 4,365,700 | 12/1982 | Arimoto et al. . | |
| 4,465,193 | 8/1984 | Kokubo et al. | 209/534 |
| 4,620,087 | 10/1986 | Aizaki | 235/379 |
| 4,625,870 | 12/1986 | Nao et al. | 209/534 |
| 4,653,697 | 3/1987 | Hashimoto | 209/534 |
| 4,722,443 | 2/1988 | Maruyama et al. | 209/534 |

FOREIGN PATENT DOCUMENTS

| | | | |
|---|---|---|---|
| 2313294 | 12/1976 | France | 414/114 |
| 55-66453 | 5/1980 | Japan | 271/296 |
| 56-63664 | 5/1981 | Japan . | |
| 56-83875 | 7/1981 | Japan . | |
| 56-147258 | 11/1981 | Japan . | |
| 57-75371 | 5/1982 | Japan | 235/379 |
| 59-33590 | 2/1984 | Japan . | |
| 59-33757 | 2/1984 | Japan . | |
| 59-08685 | 11/1984 | Japan . | |
| 60-209870 | 10/1985 | Japan | 235/379 |

*Primary Examiner*—Michael S. Huppert
*Assistant Examiner*—Edward M. Wacyra
*Attorney, Agent, or Firm*—Fay, Sharpe, Beall, Fagan, Minnich & McKee

[57] ABSTRACT

A conveying device is provided among an accommodating section for accommodating sheets of paper, a counting section for discriminating and counting the sheets of paper, and a port section through which the sheets of paper are put in and taken out of the apparatus, so as to deliver the sheets of paper to any of these components according to a transaction specified between discharge and deposit accepting transactions.

19 Claims, 13 Drawing Sheets

APPARATUS FOR HANDLING SHEETS OF PAPER

This is a divisional application of Ser. No. 874,131, filed June 13, 1986, now U.S. Pat. No. 4,884,698.

BACKGROUND OF THE INVENTION

The present invention relates to an apparatus for handling sheets of paper, and more particularly, to an apparatus for handling sheets of paper which is suitable for use in automated cash handling transactions involving depositing and drawing out bank notes.

FIG. 1 shows a known apparatus of this type. In the apparatus shown in FIG. 1, bank notes are taken out of an apparatus 30 (paid out) from a port section 36 in the following manner. The notes accommodated in cassettes 31, 32 are separated and counted at separating/accumulating sections 37, 38. The notes are then carried to the port section 36 one by one while being held by a belt 33 without being checked at a checking section 35. The notes are received from the port section (accepted as a deposit) in the following manner. The notes to be deposited which are placed at the port 36 are separated at a separating section 39, checked and counted at the checking section 35 while being held by the belt 33, and are accumulated in the cassettes 31, 32 by the separating/accumulating sections 37, 38.

In the apparatus described above, a large number of conveying routes need to be provided in a fixed manner by employing the belts 33 and rollers 34 between components including the cassettes 31, 32, the checking section 35 and the port section 36 in order to deliver the sheets of paper among these components. This increases the production cost of the conveying routes. Since these conveying routes are fixed, it is difficult to change their courses when modifying the specifications of the apparatus or expanding the functions thereof. In a case of changing them, much time and trouble are required to adjust the conveying routes. The papers are carried one by one in the apparatus, so that it takes much time to carry a large number of papers. This also increases the risk of paper being jammed at an intermediate point along the conveying routes. The apparatus uses separate paper separating/counting devices when the notes are deposited and drawn out. This increases the number of components and makes the mechanism complicated.

SUMMARY OF THE INVENTION

An object of the invention is to provide an apparatus for handling sheets of paper which is so improved as to have a simple structure by having separately formed units for each component.

Another object of the invention is to provide an apparatus for handling sheets of paper which allows for easy modification of specifications and expansion of functions.

An additional object of the invention is to provide an apparatus for handling sheets of paper which enables the paper conveying time to be reduced and the occurrence of paper jam in conveying routes to be reduced.

An apparatus for handling sheets of paper according to the present invention comprises a port section through which sheets of paper are discharged or accepted in the apparatus, a counting section for counting and checking the sheets of paper, an accommodating section for accommodating the sheets of paper, and a conveying device for transferring the sheets of paper between these plural components, wherein each of these components is made as a separately formed unit, and the conveying device is moved to any of the plural components while holding the sheets of paper.

In a preferred embodiment, the apparatus for handling sheets of paper includes at least an accommodating section for accommodating the sheets of paper, a counting section for discriminating and counting the sheets of paper and sorting the sheets of paper into those to be dealt with and those not to be dealt with, a port section through which the sheets of paper are taken out or put in, a conveying device for delivering the sheets of paper to and from each of the components when the sheets of paper are discharged, and a control section for controlling the conveying device, the port section and the counting section in accordance with a predetermined program. The conveying device has a hand section which grasps and releases the sheets of paper at a predetermined position relative to each component, and a transferring section for transferring the hand section to the predetermined position of each component. The hand section is adapted to take out en bloc a predetermined and suitable number of paper sheets in the accommodating section in a transaction involving the discharge of paper sheets.

In a further embodiment of the invention, the hand section is adapted to take out the paper sheets in the accommodating section in a number which is more than the maximum dischargeable number, in a number which is more than the average discharging number in one discharge, or in a number which is more than the number specified by a customer in a transaction involving the discharge of sheets of paper.

According to the present invention, the components are formed into separate units and constructed independently. This makes the structure of the apparatus simpler, while improving the quality thereof. Moreover, it is economical.

The operation of the conveying device is not fixed but is controlled by a controlling program, ensuring that modification of the specifications of the apparatus and expansion of the functions can be effected more freely.

The sheets of paper are transferred among the components en bloc. Therefore, only one transferring operation is required. The conveying device travels while it holds the sheets of paper. Therefore, the processing time is reduced, and the number of jams occurring during conveyance can be remarkably reduced.

DESCRIPTION OF THE PREFERRED EMBODIMENTS

Figure 1:
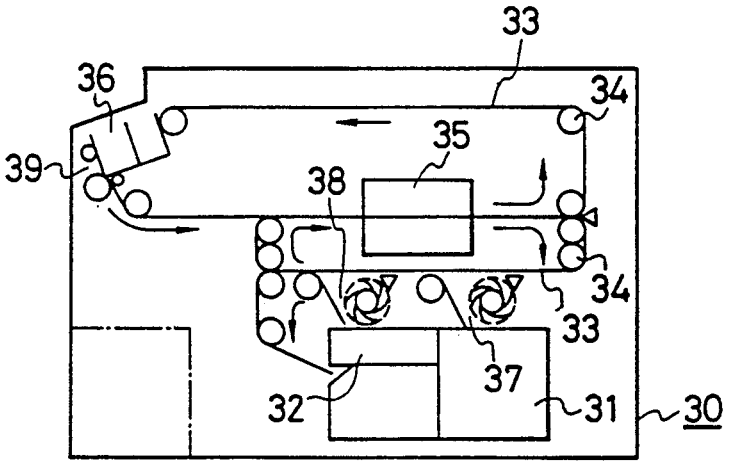
FIG. 1 PRIOR ART
FIG. 1 shows the configuration of a known example.

A first embodiment of the present invention will be described hereinunder with reference to FIGS. 2 to 4.

An apparatus for automatically conducting cash handling transactions of the first embodiment accepts one type of note (ten thousand yen notes, for example), and comprises an accommodating mechanism 1 for notes (accommodating section), a counting mechanism 2 (counting section), a port mechanism 3 (port section), a conveying device 4 (conveying section) and a control section 5.

A reader/writer of identification cards or magnetic cards which act as the media for a transaction, or keys operated by a customer (both not shown), are disposed above these components.

In the apparatus, the counting mechanism 2 is disposed above the note accommodating mechanism 1 and the control section 5 such that the counting mechanism 2 is stacked thereon, while these components spaced apart from the port mechanism 3 by a predetermined interval L.

The conveying device 4 is disposed in the gap between the counting mechanism 2 and the port mechanism 3, so that it may deliver sheets of paper among each of those components 1, 2 and 3.

The accommodating mechanism 1 includes an upper half cashbox 1*a* and a lower half cashbox 1*b*, both accommodating notes to be used in a transaction involving the discharge of notes by having the notes stacked vertically. The cashboxes 1*a* and 1*b* respectively have a port 11 through which the notes are taken out of and put in the cashbox 1*a* and a retrieving port 12 through which those notes which are for some reason retrieved are received in the cashbox 1*b*. The accommodating mechanism 1 is provided at the rear of a supporting table 6.

The counting mechanism 2 is adapted, in the case of a paying transaction, to check the notes to be discharged, count them out to a number specified by a customer, and sort them into those to be dealt with and those not to be dealt with. In an accepting transaction, the counting mechanism 2 is adapted to check and count the notes deposited and separate them into valid and counterfeit notes.

Figure 3:
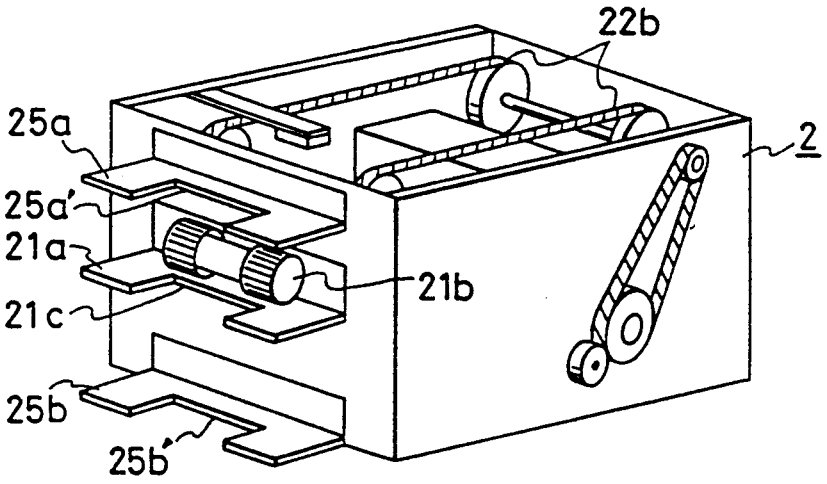
FIG. 3 is a perspective view of a counting section.
Figure 4:
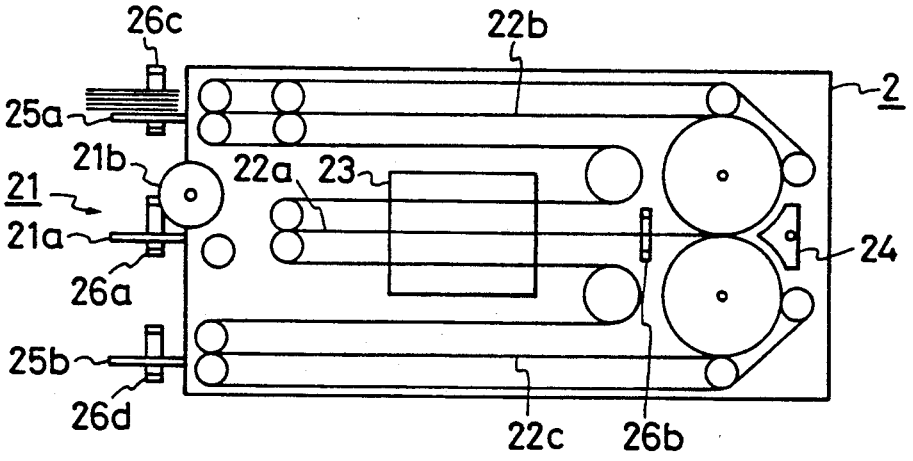
FIG. 4 is a sectional view of the counting section.

More specifically, the counting mechanism 2, as shown in FIGS. 3 and 4, includes a receiving section 21 for accepting the notes inside the counting mechanism 2, the receiving section 21 having a table or station 21*a* and a feed roller 21*b*; a main conveying passage 22*a* for carrying the received notes; loop conveying passages 22*b*, 22*c* provided at the exit side of the main conveying passage 22*a* and which are for conveying the notes to either loop depending on whether the notes are to be dealt with or not to be dealt with, respectively, in a discharging transaction; a discriminator 23 for discriminating between notes to be dealt with and those not to be dealt with and a counter for counting the notes to be dealt with, the discriminator 23 being provided in the main conveying passage 22*a*; a gate 24 for sending the notes to the loop conveying passages 22*b* and 22*c*, the gate 24 being provided between the main conveying passage 22*a* and the loop conveying passages 22*b*, 22*c*; stack sections or stations 25*a*, 25*b* for temporarily retaining the notes fed through the conveying passages 22*b* and 22*c*, respectively; a plurality of sensors 26*a* to 26*d*; and a case 27 for housing these components at their determined positions. It is to be noted that in a deposit accepting transaction the conveying passages 22*b*, 22*c* convey the notes not to be dealt with and those to be dealt with, respectively, and that the stack sections 25*a*, 25*b* are used accordingly.

The receiving section 21 and individual stack sections 25*a*, 25*b* are respectively disposed one above the other, preferably along a common vertical plane, on the same side of the case 27 i.e., on the front side thereof, so that horizontal stacks of notes are formed in parallel with one another.

In the counting mechanism 2, the notes which are placed on the table 21*a* of the receiving section 21 in a discharge transaction are detected by the sensor 26*a*, and are separately moved in the main conveying passage 22*a* one by one by means of the rotation of the feed roller 21*b*. The notes are then conveyed through the main conveying passage 22*a*. When they pass through the discriminator 23, the discriminator 23 differentiates notes to be dealt with from those not to be dealt with by determining whether the passing notes are valid or not and by detecting the extent to which each note is soiled. At the exit of main conveying passage 22*a* is a gate 24. The gate 24 opens the passage to either conveying passage 22*b* or 22*c* when the sensor 26*b* detects the presence of the note discriminated, so that the notes to be dealt with and those not to be dealt with are appropriately introduced to the loop conveying passages 22*b* and 22*c*, respectively. Thus, the notes to be dealt with are then loop conveyed through the conveying passage 22*b*, and are detected by the sensor 26*c* so that a specified number of notes are retained on the stack section 25*a*. The notes not to be dealt with are conveyed through the loop conveying passage 22*c*, and are detected by the sensor 26*d* so that they are retained on the stack section 25*b*. If notes still remain on the table 21*a* when the specified number of notes are prepared on the stack section 25*a*, the remaining notes are sent to the stack section 25b through the main conveying passage 22a and the loop conveying passage 22c.

The port mechanism 3 has a port 3a through which the notes are taken out, and is disposed at the upper and front portion of the supporting table 6 in such a manner as to face the counting mechanism 2.

In the counting mechanism 2, the deposited notes which are placed on the table 21a of the receiving section 21 after being deposited by a customer in an accepting transaction are detected by the sensor 26a, and are accepted into the main conveying passage 22a one by one by means of the rotation of the feed roller 21b. The notes are then conveyed through the main conveying passage 22a. When they pass through the discriminator 23, the discriminator 23 differentiates notes to be dealt with from those not to be dealt with by determining whether the passing note is valid or not and by detecting the extent to which each note is soiled. The gate 24 opens the passage to either conveying passage 22b or 22c when the sensor 26b detects the presence of the discriminated note, so that the counterfeit or damaged notes, i.e., notes to be returned to the customer, and the valid notes, i.e., the notes to be received, are introduced to the loop conveying passages 22b and 22c, respectively. The notes to be returned are conveyed through the conveying passage 22b, and are detected by the sensor 26c so that they are piled on the stack section 25a. The notes to be accepted are conveyed through the conveying passage 22c, and are detected by the sensor 26d so that they are piled on the stack section 25b.

The conveying device 4 is disposed on the supporting table 6 between the port mechanism 3 and the counting mechanism 2 and at the front of the accommodating mechanism 1, so as to distribute the notes among the port mechanism 3, counting mechanism 2 and accommodating mechanism 1. For that purpose, the conveying device 4 has, as shown in FIGS. 2 to 5, a hand section 41 for grasping and releasing the notes and a transferring section 42 for transferring the hand section 41 to any of a number of predetermined positions relative to the mechanisms 1, 2 and 3.

Figure 5:
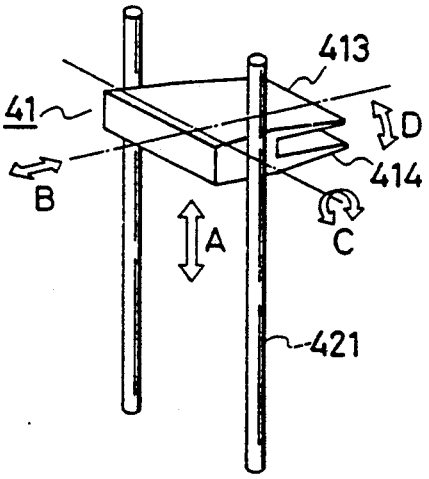
FIGS. 5(*a*) and 5(*b*) are perspective views of a conveying while FIG. 5(*c*) is a perspective view of an alternative embodiment of a conveying section.
Figure 5:
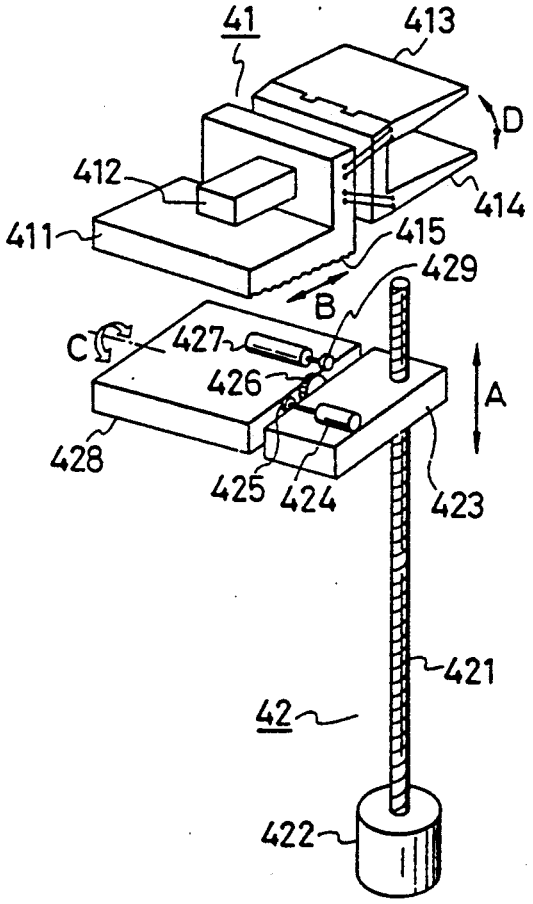
Figure 5:
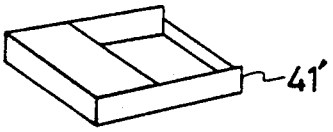

The hand section 41 shown in FIGS. 5(*a*) and 5(*b*) has a body 411 having a solenoid 412 for opening and closing fingers, and the body 411 is provided with a pair of fingers 413, 414 which open and close by means of the magnetic force of the solenoid 412 in the direction shown by the arrow D. The pair of fingers 413, 414 grasps the notes on being closed and releases the notes when opened.

The transferring section 42 has: a pair of screw shafts 421 provided vertically between the port mechanism 3 and counting mechanism 2/accommodating mechanism 1; a vertical motor 422 connected to the lower portion of each screw shaft 421; a supporting plate 423 threaded with each screw shaft 421, the supporting plate having a rotating motor 424; a sliding table 428 having a gear 426 provided at each side thereof which is threaded with a gear 425 mounted on the rotating shaft of the rotating motor 424, a central axis of the gear 426 being supported by the supporting plate 423, the sliding table 428 further having a horizontal motor 427 provided on the upper surface thereof; a pinion 429 mounted on the rotating shaft of the horizontal motor 427 and engaging with a rack 425 mounted on the body 411 of the hand section 41; and a retaining portion (not shown) for retaining the hand section 41 on the sliding table 428 in the state wherein the pinion 429 and the rack 415 are engaged with each other.

When the vertical motors 422 are driven so as to rotate the screw shafts 421, the supporting plates 423 and the sliding table 428 are moved in the direction shown by the arrow A, so that the hand section 41 is transferred in the same direction A. When the rotating motors 424 are driven and the gears 425 are rotated, the gears 426 engaging with the gears 425 are rotated around the gears 425 and the sliding table 428 is rotated around the rotating shaft of the rotating motor 424 in the direction shown by the arrow C, so that the hand section 41 is rotated in the same direction C. When the horizontal motor 427 is driven so as to rotate the pinion 429, the body 411 of the hand section is transferred by the rack 415 engaging with the pinion 429 in the direction shown by the arrow B, so that the hand section 41 is moved in the same direction B.

In the transferring device 4, when a discharging transaction is conducted, the hand section 41 takes out the notes in the accommodating mechanism 1, and is transferred to the counting mechanism 2 by the transferring section 42 so as to deliver the notes to the receiving section 21 of the ,counting mechanism 2. The hand section 41 then grasps from the stack section 25a those notes which were determined by the counting mechanism 2 to be notes to be dealt with, and is transferred to the port mechanism 3 by the transferring section 42 such as to deliver the notes to the port 3a. Subsequently, the hand section 41 grasps in the stack portion 25b the notes which were determined by the counting mechanism 2 to be notes not to be dealt with, and is transferred to the accommodating mechanism 1 by the transferring section 42 so as to deposit the notes not to be dealt with in the cashbox 1a of the accommodating mechanism 1.

Figure 2:
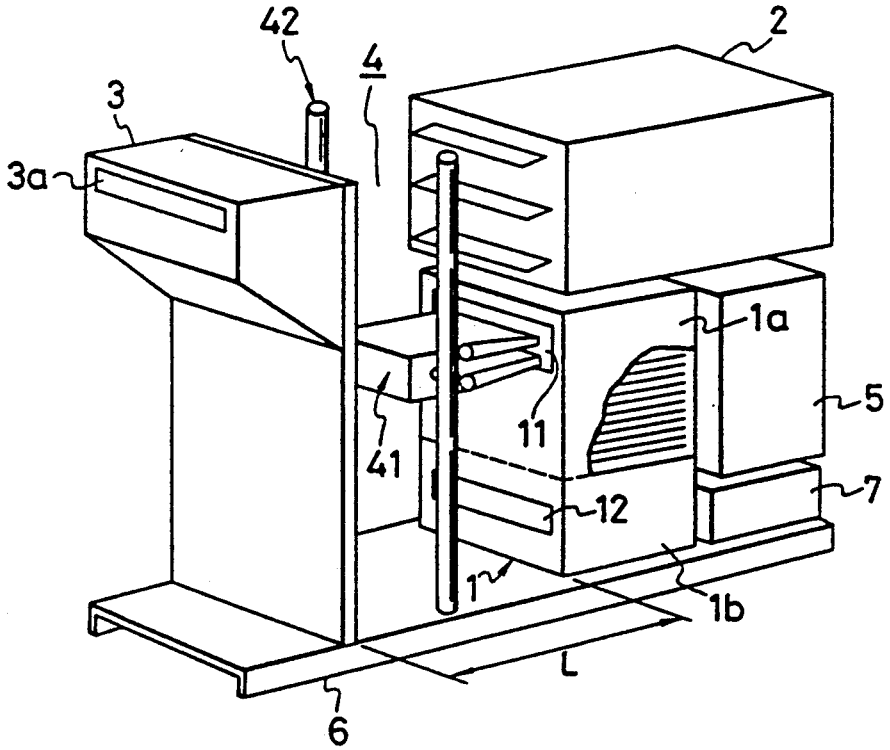
FIG. 2 is a perspective view of a first embodiment of an apparatus for handling sheets of paper according to the present invention, which is applied to automated cash handling transactions.

For these purposes, the table 21a of the receiving section 21 is provided with a notch 21c so that the hand section 41 can hand over the notes, as shown in FIG. 2 and 3. Also, the stack portions 25a, 25b are provided with notches 25'a, 25'b, respectively, so that the hand section 41 can grasp the notes retained thereon. The port 12 of the accommodating mechanism 1 has a size large enough to enable the hand section 41 to enter and to grasp and release the notes therein.

In the transferring mechanism 4, when a deposit accepting transaction is conducted, the hand section 41 takes out the notes in the port mechanism 3, and is transferred to the counting mechanism 2 by the transferring section 42 so as to deliver the notes to the receiving section 21 of the counting mechanism 2. The hand section then grasps in the stack portion 25a those notes which were determined by the counting mechanism 2 to be notes to be returned to the customer, and is transferred to the port mechanism 3 by the transferring section 42 so as to return the notes to the port 3a. Subsequently, the hand section 41 grasps the notes in the stack portion 25b which were determined by the counting mechanism 2 to be notes to be accepted, and is transferred to the accommodating mechanism 1 by the transferring section 42 so as to deliver the notes to the cashbox 16 of the accommodating mechanism 1.

The hand section 41 may alternatively be in the form of a tray 41', as shown in FIG. 5(*c*).

The control section 5 controls the transferring device 4, accommodating mechanism 1, counting mechanism 2, and port mechanism 3 according to the programs set for each type of transaction. The control section 5 therefore is provided with a memory (not shown) for storing these operation sequences and a microcomputer for reading and performing the operation sequences.

The control section 5 is disposed on the supporting table 6 at the rear of the accommodating mechanism 3.

In FIG. 2, reference numeral 7 designates a power source.

Thus, in a discharging transaction, the hand section 41 of the conveying device is adapted to grasp and take out en bloc in the accommodating mechanism 1 a suitable number of notes. More specifically, the hand section 41 is adapted to grasp en bloc in the accommodating mechanism 1 a number of notes which is slightly more than the maximum dischargeable number which a customer can draw out in one operation from the apparatus. The gap between the pair of fingers 413, 14 of the hand section 41 is therefore preset so that the fingers can grasp in the accommodating mechanism 1 a number of notes which is slightly more than the maximum dischargeable number.

The operation involving the discharging transaction conducted by this embodiment of the apparatus for automatically conducting cash handling transactions will be described hereinunder with reference to FIGS. 6 to 8.

Figure 6:
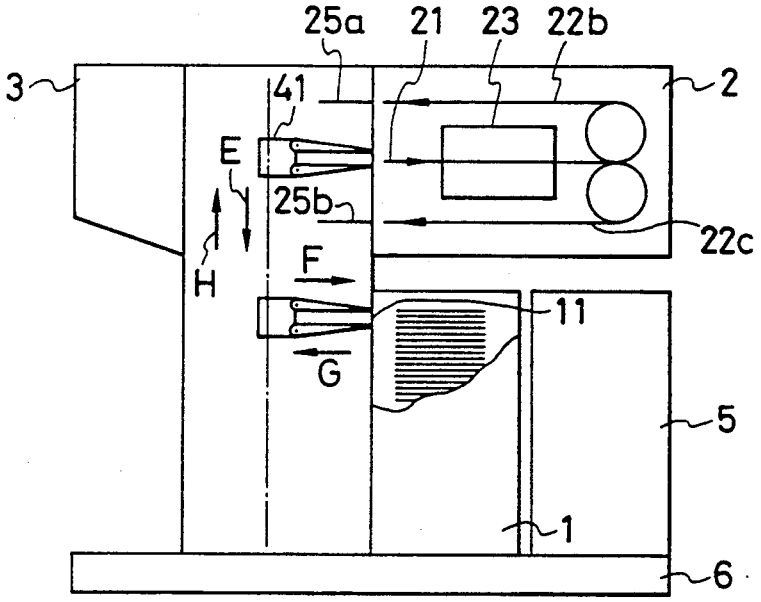
FIG. 6 shows in an explanatory way the operation of a hand which takes out sheets of paper from an accommodating section in a transaction involving the discharge of sheets of paper.

The hand section 41 of the conveying device 4 is at a position at the initial stage where it faces the receiving section 21 of the counting mechanism 2, as shown in FIG. 6.

When a customer operates a discharging transaction and specifies the amount of cash to be paid from the operating section, the hand section 41 moves downward to the position facing the port 11 of the cashbox 1*a* of the accommodating mechanism 1 immediately, as shown by the arrow E of FIG. 6, and then moves forward into the port 11, as shown by the arrow F of FIG. 6, such as to grasp and take out a suitable number of notes en bloc from the upper portion of the pile of notes in the cashbox 1*a*.

At this time, the hand section 41 grasps the notes in a number which is slightly larger than the maximum dischargeable number allowed in one transaction, i.e., in a number which is always larger than the number specified by the customer.

Figure 8:
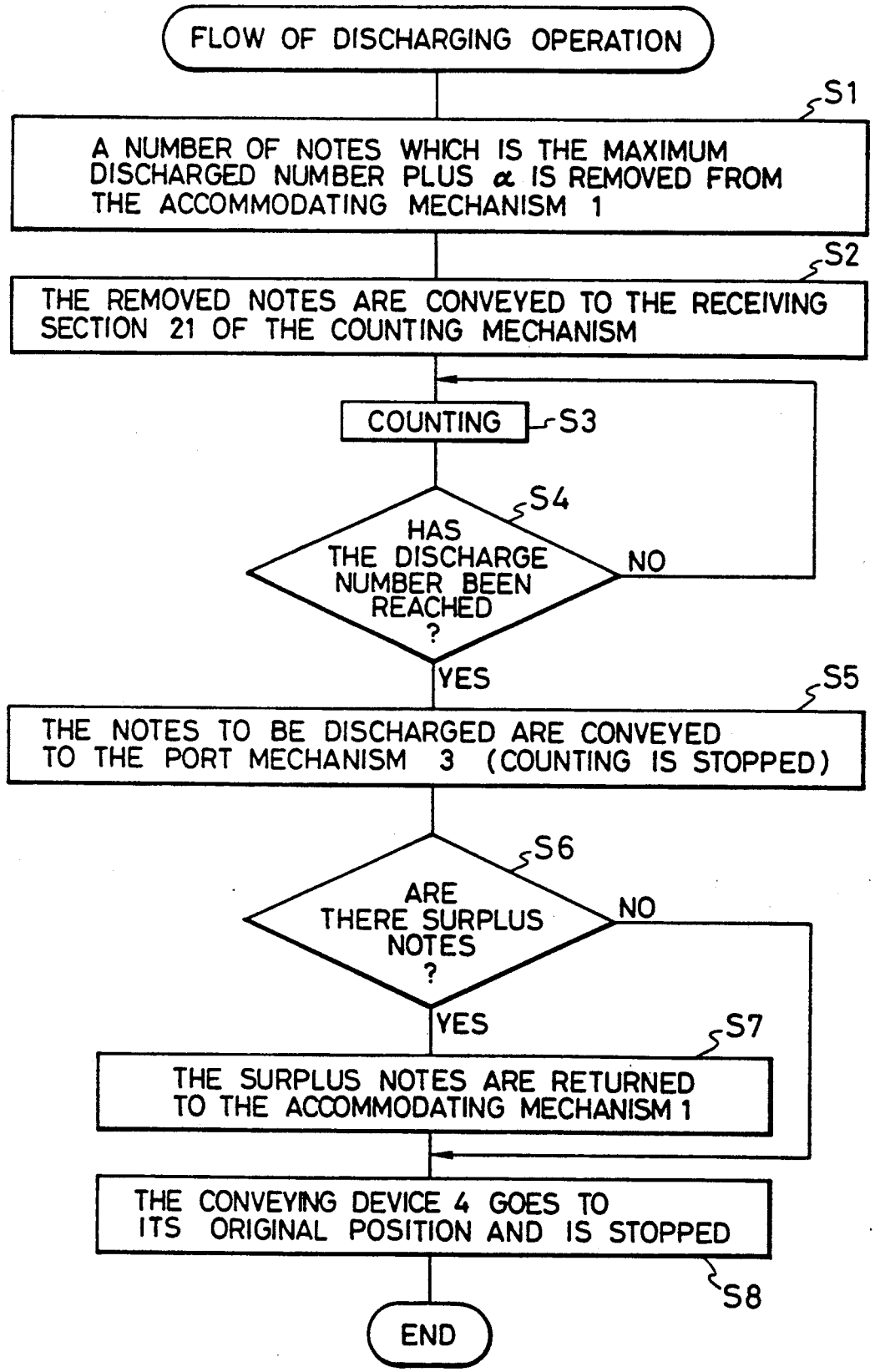
FIG. 8 is a flowchart of the operation performed for a transaction.

After grasping the notes en bloc in the manner described above, the hand section 41 retreats in the direction shown by the arrow G of FIG. 6 so as to take out the notes from the accommodating mechanism 1 (S1 of FIG. 8). The hand section 41 then moves upward in the direction shown by the arrow H, stops temporarily at a position where it faces the receiving section 21 of the counting mechanism 2, and moves forward such as to place the bundle of notes on the table 21*a* of the receiving section 21 (S2 of FIG. 8). The notes placed are accepted into the counting mechanism 2 by the rotation of the feed roller 21*b* (FIG. 3) of the receiving section 21, and are discriminated and counted by means of the discriminator 23, gate 24 and sensor 26*c* (S3). At this time, it is judged whether the number of notes has reached the number which is specified by the customer (S4). If not, the notes to be dealt with continue to be passed through the conveying passage 22*b* and piled on the stack portion 25*a* until the specified number is reached. When it is determined that the number has been reached, counting is stopped, and the notes exceeding the amount to be paid are conveyed to and piled on the stack section 25*b* as notes not to be dealt with.

Figure 7:
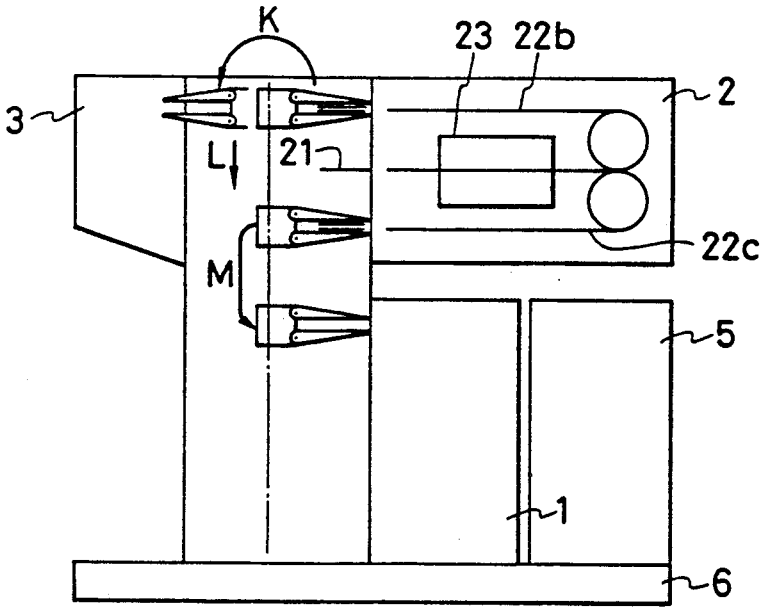
FIG. 7 shows in an explanatory way the operation of the hand which carries the sheets of paper to a port section in a transaction involving the discharge of sheets of paper.

The hand section 41 which has been positioned at the receiving section 21 then moves upward toward the stack section 25*a*, moves forward to the stack section 25*a* such as to grasp the notes piled on the stack section 25*a* (S5 of FIG. 8), and rotates by 180° in the direction shown by the arrow K of FIG. 7, so that it releases the notes at the port 3*a* of the port mechanism 3. The notes discharged in this manner can be pulled out by the customer.

Thereafter, the hand section 41 rotates in the direction opposite to that shown by the arrow K, moves downward in the direction shown by the arrow L to the stack section 25*b* such as to grasp the bundle of notes piled on the stack section 25*b*. The hand section 41 then moves further downward as shown by the arrow M, enters the port 11 of the cashbox 1*a*, and releases the held notes onto the pile of notes in the cashbox 1*a* (S7).

The hand section 41 of the conveying device 4 then returns to its initial position (original position) and stops (S8).

As will be clear from the foregoing description, in the apparatus of this embodiment, the port mechanism 3, counting mechanism 2 and accommodating mechanism 1 are formed as separate units and the notes are distributed among those components 1 to 3 by the conveying device 4. In consequence, the structure of the accommodating mechanism 1 can be made simpler and the number of parts thereof can be decreased, compared with the known apparatus in which the accommodating mechanism has note accepting and discharging functions. Moreover, since the respective components 1 to 4 are separately formed, the method of assembling these components can be improved.

In the conveying device 4, the notes are gripped and conveyed by the hand section 41, thus requiring no belts. Therefore, it is possible to eliminate the fluctuations of carrying speed which would occur in the prior art when the length of the belt was changed. This therefore enables an adequate control of the conveying device 4.

The notes in the accommodating mechanism 1 are grasped by the hand section 41 in a number which is more than the maximum dischargeable number. Therefore, only one operation is necessary. This also enables the conveying time of notes in the transaction to be remarkably reduced, allowing the speeding up of the payment to the customer.

Figure 9:
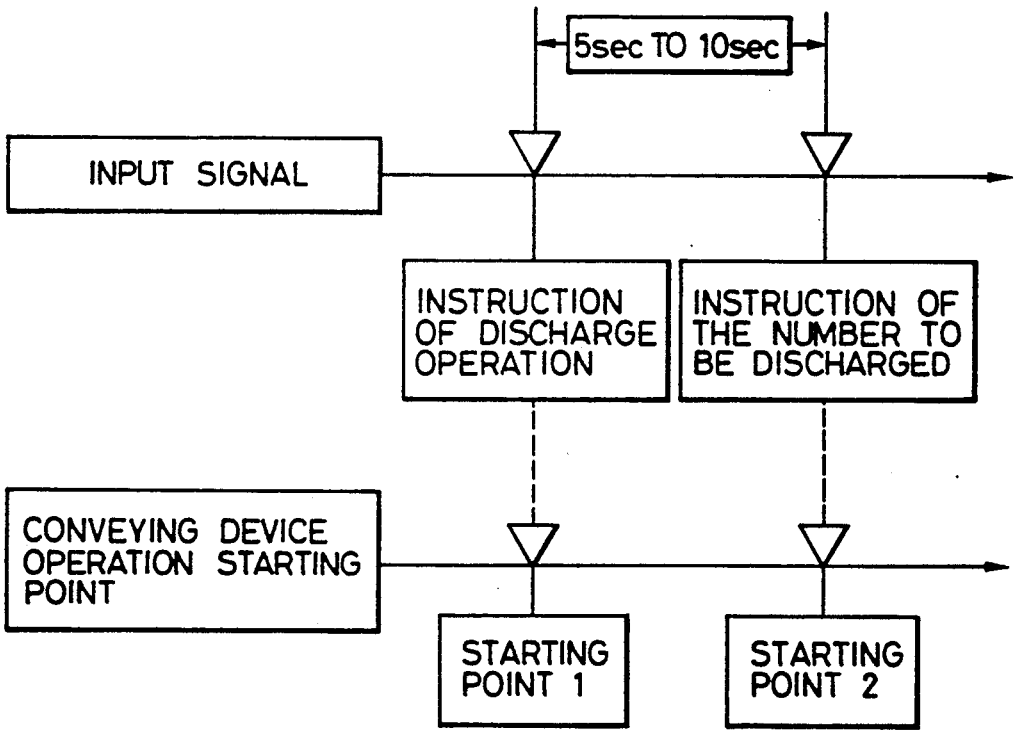
FIG. 9 shows in an explanatory way the situation when the operation of the conveying device is started.

The hand section 41 may be instructed to start moving towards the accommodating mechanism 1, as shown in FIG. 9, at the point when the customer specifies the paying transaction, although the starting time may be slightly changed depending on the carrying distance and moving speed (starting point 1). The hand section 41 may be instructed to have already begun taking out note at the point when the amount to be paid is specified by the customer (starting point 2). This allows the discharging time to be further reduced.

Figure 10:
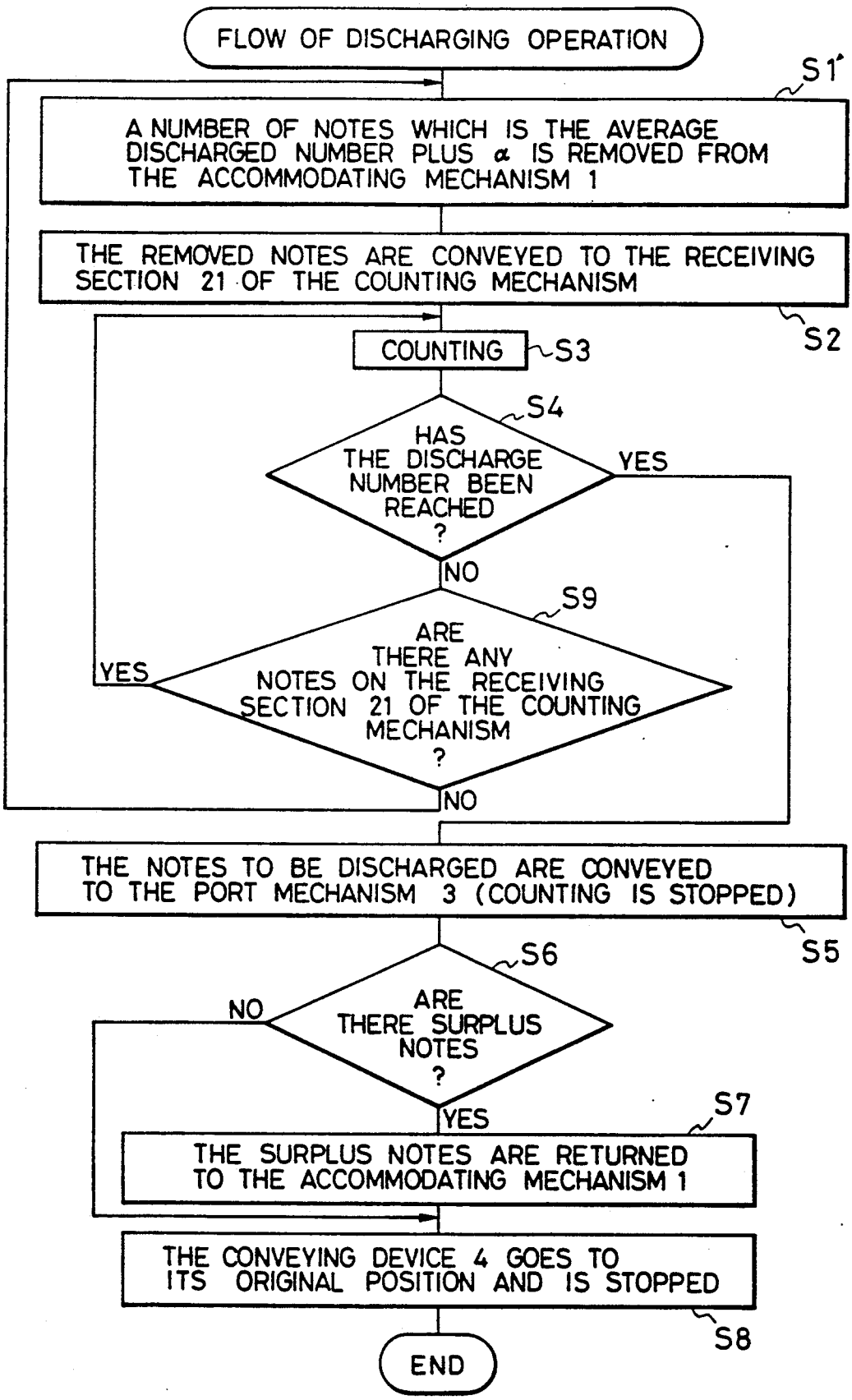
FIG. 10 is a flowchart of the operation of the apparatus, showing a second embodiment of the present invention.

FIG. 10 is a flowchart of the operation conducted by the apparatus of a second embodiment of the present invention. The apparatus of this embodiment is different from that of the first embodiment in that in a discharging transaction the notes in the accommodating mechanism 1 are taken out en bloc by the hand section 41 in a number which is more than the average discharged number. The average discharged number in this case means the average number of notes which are drawn out by the customers in a discharge transaction at the site where the apparatus is installed.

In consequence, the amount of money specified by the customer could exceed the average amount, i.e., the number of notes which are taken out en bloc by the hand section 41 from the accommodating mechanism 1. Therefore, as shown in FIG. 10, if it is judged in S4 that the number of notes which have been sorted to be dealt with by the counting mechanism 2 have not reached the amount specified by the customer, the processing goes to S9 in which it is determined if notes still remain in the receiving section 21 of the counting mechanism 2. If the answer is Yes, the processing returns to S3. If No, the processing goes back to S1.

In this embodiment, if the amount specified by the customer exceeds that of the average discharged number, another bundle of notes is taken out from the accommodating mechanism 1 by the hand section 41 of the conveying device 4. However, the number of notes taken by the hand section 41 is an average one, and in most of the transactions only one operation is necessary. Further, the number of notes taken out by the hand section 41 is smaller than that of the first embodiment but not too small, and this ensures that the hand section 41 grasps the notes accurately.

In this embodiment, like the first embodiment, since the operation of the hand section 41 (which removes the notes) can be commenced at starting point 1 of FIG. 9, the note discharging time can be reduced.

Figure 11:
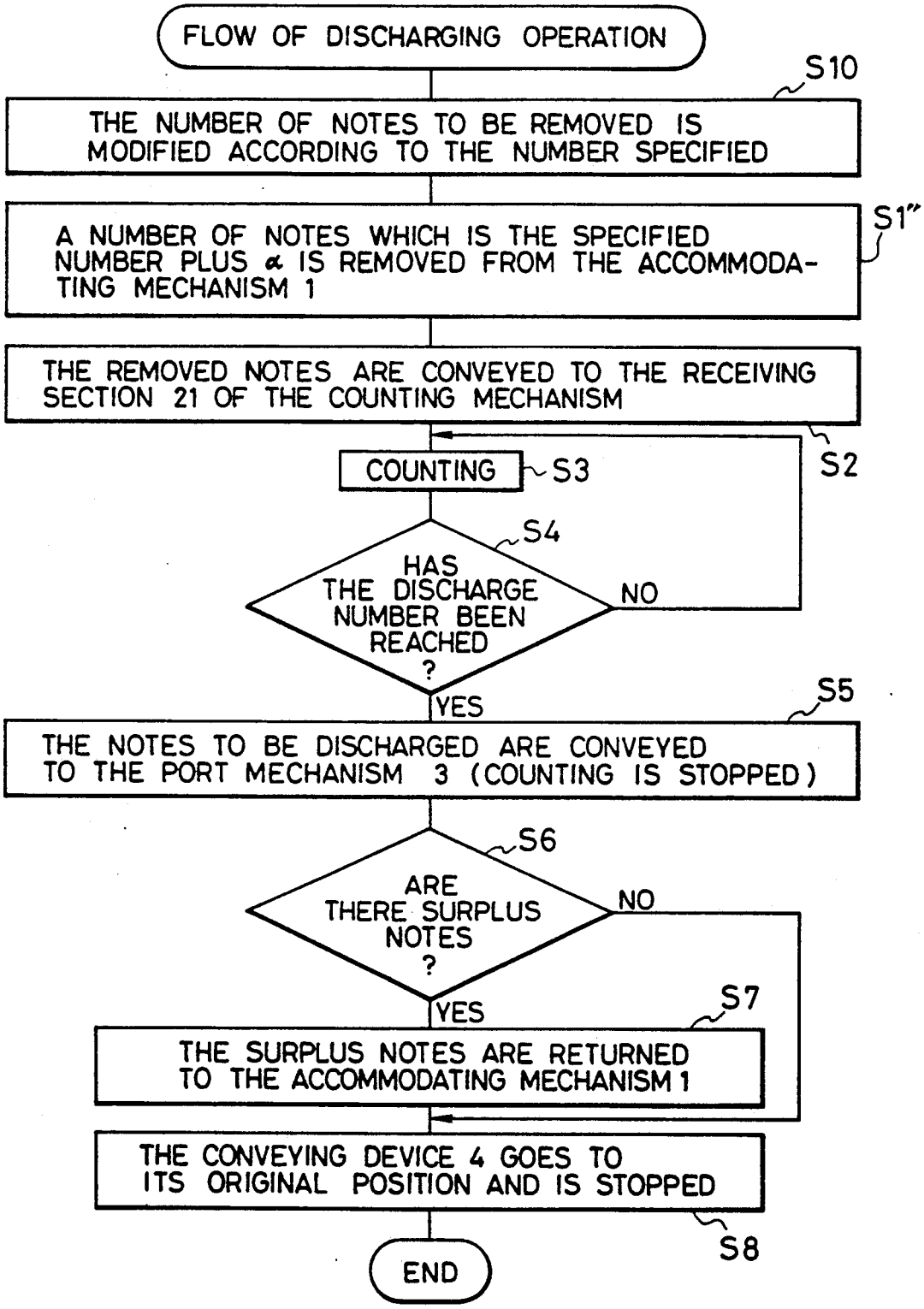
FIG. 11 is a flowchart of the operation of the apparatus, showing a third embodiment of the present invention.

FIG. 11 is a flowchart of the operation of the third embodiment of the present invention. The apparatus of this embodiment is different from the foregoing two embodiments in that the notes are taken out from the accommodating mechanism 1 en bloc by the hand section 41 of the conveying device 4 in a number which is slightly larger than the one specified by the customer. In consequence, when the hand section 41 grasps the notes in the accommodating mechanism 1, the number of notes to be grasped is modified according to the amount to be paid (S10). The gap between the fingers 413, 414 of the hand section 41 is then adjusted accordingly.

Thus, in this embodiment, only one operation of the hand section 41 is necessary, when the hand section 41 takes out the notes from the accommodating mechanism 1. Further, the number of notes to be returned to the accommodating mechanism 1 can be reduced. Further, after the counting mechanism 2 has sorted notes to the number specified by the customer, the number of notes not to be dealt with which are carried to the stack section **25*b*** can be reduced, thereby reducing the processing time thereof.

A fourth embodiment of the present invention will be described hereinunder with reference to FIGS. 12 to 14.

In each of the foregoing embodiments, when it is determined at S4 in the flowchart that the number to be discharged has been reached, counting is suspended at S5, while the notes exceeding the amount to be paid are conveyed to the stack section **25*b* as the notes not to be dealt with. In this embodiment, however, if the answer is Yes in S4, the counting and the conveyance are suspended at S5'. In consequence, the surplus notes, if any, remain in the receiving section 21 after the number to be discharged has been reached. These surplus notes in the receiving section 21 are then returned to the accommodating mechanism 1 in S6'**.

The operation of the apparatus of this embodiment will be described below referring to FIGS. 13 and 14. Referring first to FIG. 13, when the specified number has been reached by the counting mechanism 2, the conveyance of the notes is stopped.

Figure 12:
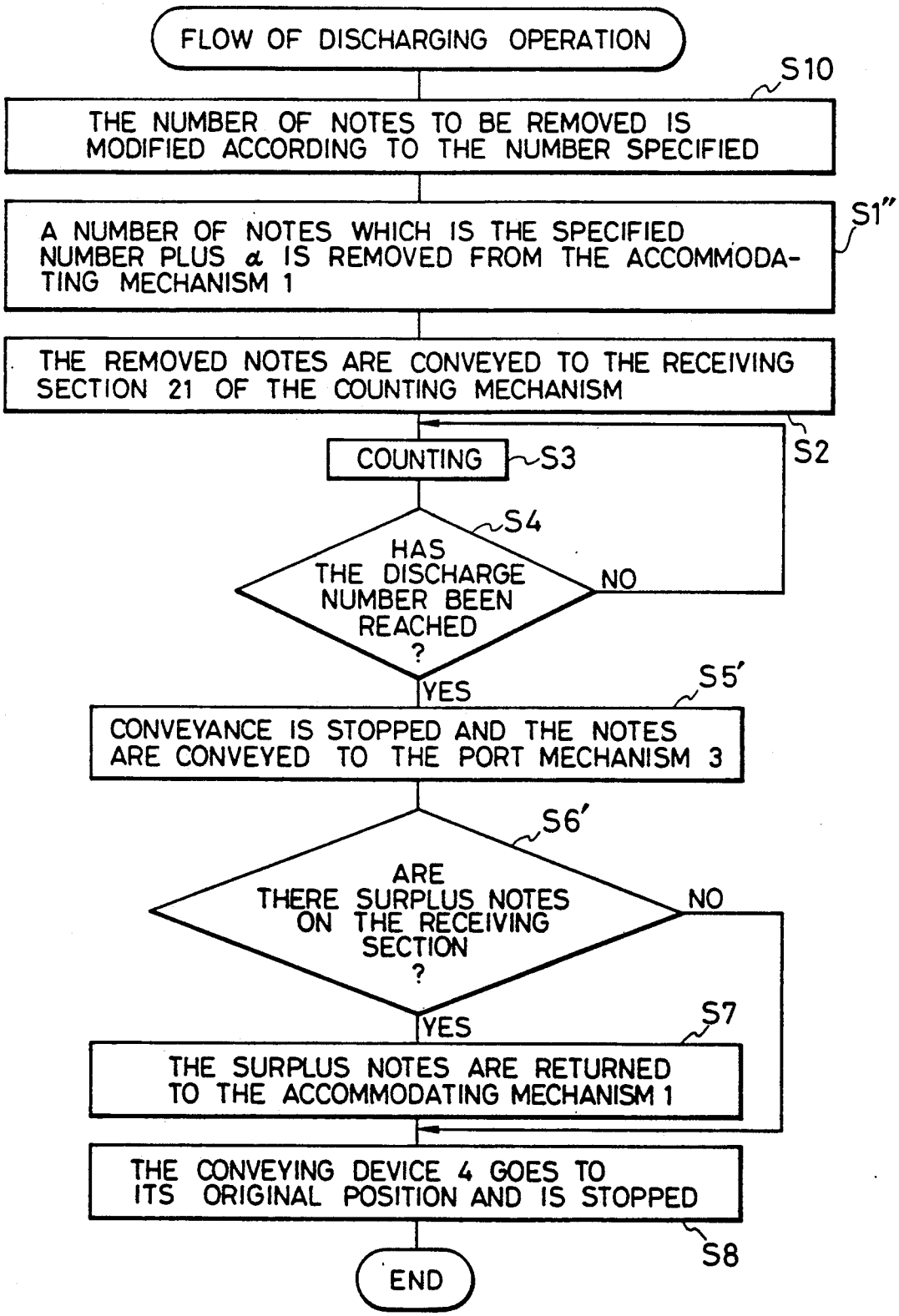
FIG. 12 is a flowchart of the operation of the apparatus, showing a fourth embodiment of the present invention.
Figure 13:
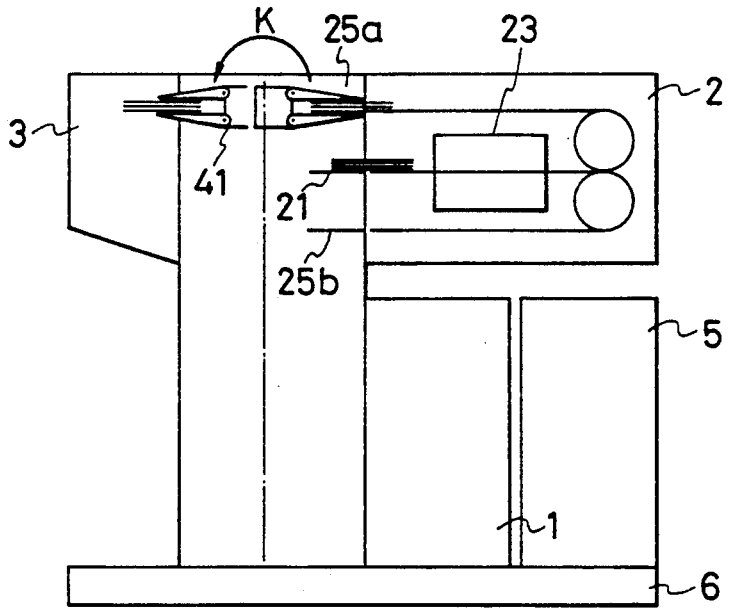
FIGS. 13 and 14 respectively show the processes of a paying operation performed by the apparatus shown in FIG. 12.

Thereafter, the hand section 41 moves upward from the receiving section 21 toward the stack section **25*a*, moves forward to the stack section 25*a*, and grasps the pile of notes on the stack section 25*a* (S5' of FIG. 12). The hand section 41 then rotates by 180° in the direction shown by the arrow K in FIG. 13, so that it delivers the notes to the port 3*a* of the port mechanism 3** and releases the notes.

Figure 14:
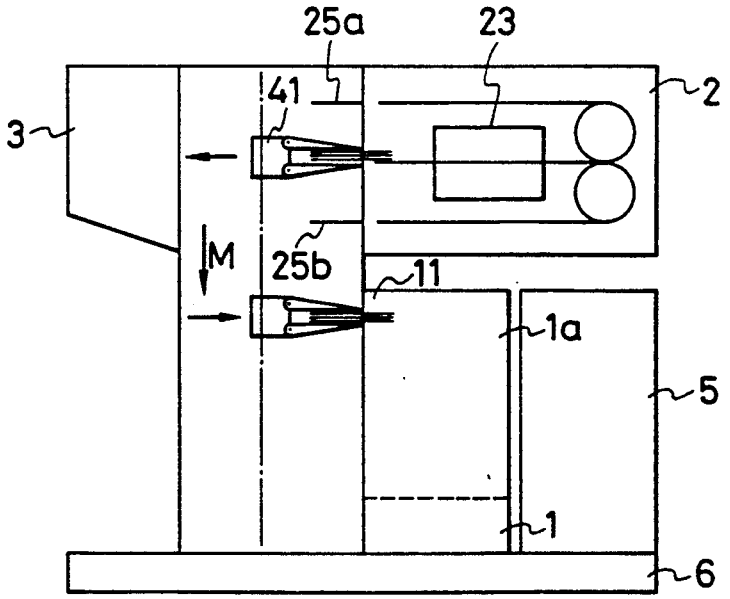

The hand section 41 then rotates in the direction opposite to that shown by the arrow K, moves downward as shown by the arrow L, and grasps the bundle of notes piled on the receiving section 21, as shown in FIG. 14. The hand section 41 then moves further downward as shown by the arrow M, enters the port 11 of the cashbox **1*a*, and releases the notes onto the pile of notes in the cashbox 1*a* (S7**).

The hand section 41 of the conveying device 4 returns to its initial position (original position) and stops there (S8).

As will be understood from the foregoing description, when the specified number has been reached in this embodiment, conveyance of the notes exceeding the amount to be paid is suspended, i.e., it is not necessary to convey the surplus notes to the stack section **25*b***, as is the case in the foregoing embodiments. This enables the processing time to be reduced.

Figure 15:
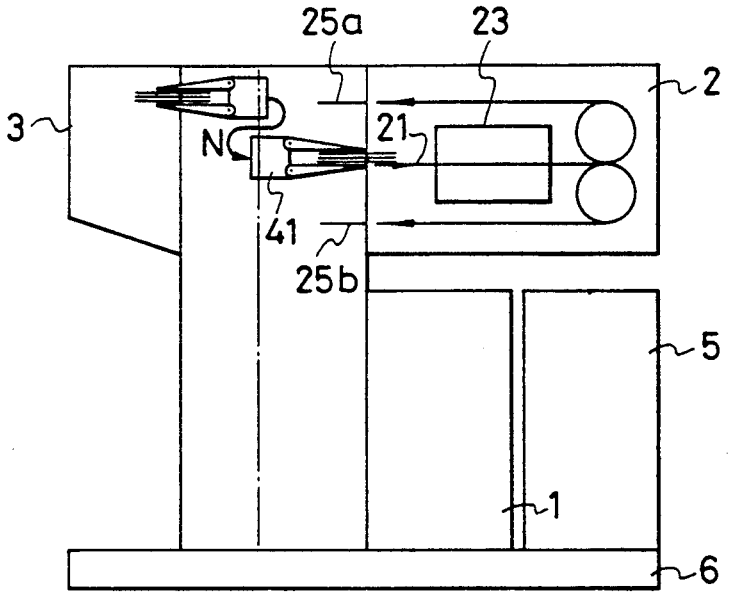
FIGS. 15 and 16 respectively show the processes of a deposit accepting operation conducted by the apparatus shown in FIG. 12.
Figure 16:
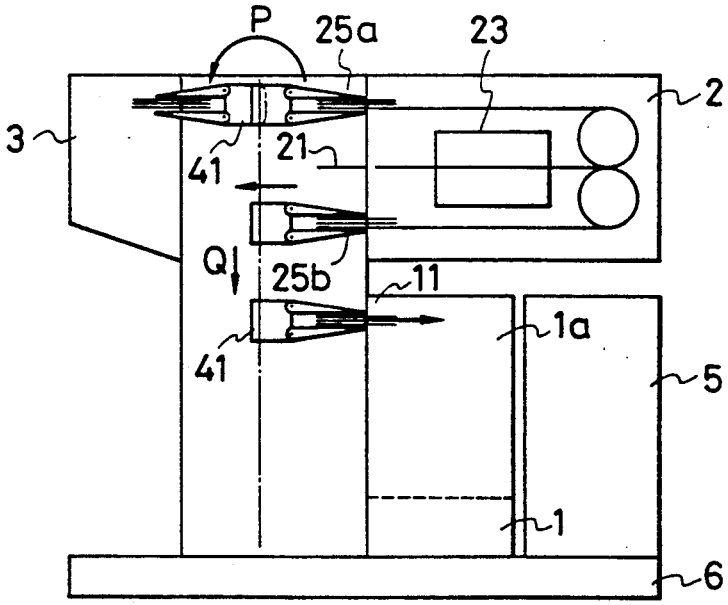
Figure 17:
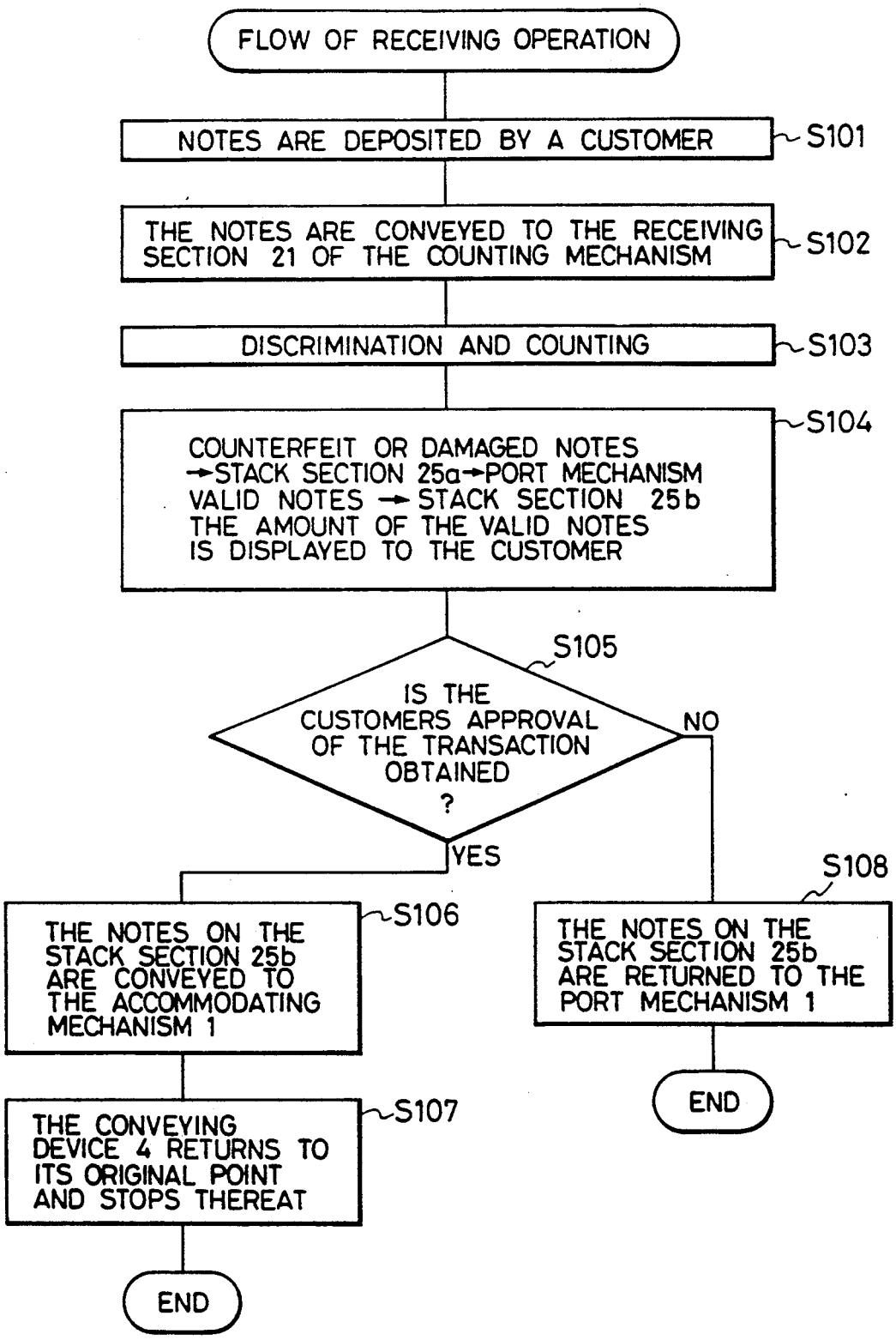
FIG. 17 is a flowchart of the operation of the apparatus shown in FIG. 12.

The operation of a deposit accepting transaction will be described below with reference to FIGS. 15 to 17. As in the paying transaction, the hand section 41 is at a position in its initial stage where it faces the receiving section 21 of the counting mechanism 2. When the customer specifies the depositing transaction as well as the amount to be deposited, the hand section 41 moves to and waits at the port mechanism 3, as shown in FIG. 15. The hand section 41 then grasps the bundle of notes deposited in this portion, turns over, as shown by the arrow N, moves downward, and delivers the notes to the receiving section 21 of the counting mechanism 2 (S102).

The notes which have been carried to the counting mechanism 2 are accepted one by one as the feed roller **21*b* rotates so that they are sorted and counted (S103). The notes are then conveyed selectively to the stack sections 25*a* and 25*b*. Assume that valid notes are conveyed to the stack section 25*b*, while the counterfeit or damaged notes are sent to the stack section 25*a*. The hand section 41 grasps the bundle of notes on the stack section 25*a* and returns them to the port mechanism 3, as shown by the arrow P of FIG. 16 (S104). At this point, the amount of the valid notes is displayed to the customer, and the customer's approval of the displayed amount is requested. The notes returned in the above-described manner may be redeposited a port mechanism 3** for a second trial. If the returned notes are not redeposited the customer instructs from the operating section whether he approves the transaction with the amount displayed or cancels it.

If the transaction is approved, i.e., if the answer is Yes in S105, S106 is then executed in which the hand section 41 grasps en bloc the valid notes at the stack section **25*b*, moves backward, moves downward in the direction shown by the arrow Q, moves forward to the accommodating mechanism 1, enters the port 11 of the cashbox 1*a***, and releases the notes onto the pile of notes in the cashbox.

The hand section 41 then returns to its initial position (original position) and stops thereat (S107).

If the transaction is cancelled by the customer in S105, i.e., if the answer at S105 is No, then S108 is executed in which the valid notes at the stack section 25*b* are returned to the port mechanism 3, and the transaction is thereby ended.

The above-described embodiment uses only one hand section 41. However, two or more of them may be employed. If two hand sections are used, one hand section may be adapted to take care of the conveyance between the port mechanism 3 and the counting mechanism 2 while the other one may be adapted to carry notes between the counting mechanism 2 and the accommodating mechanism 1, and the processing time can be further reduced.

Figure 18:
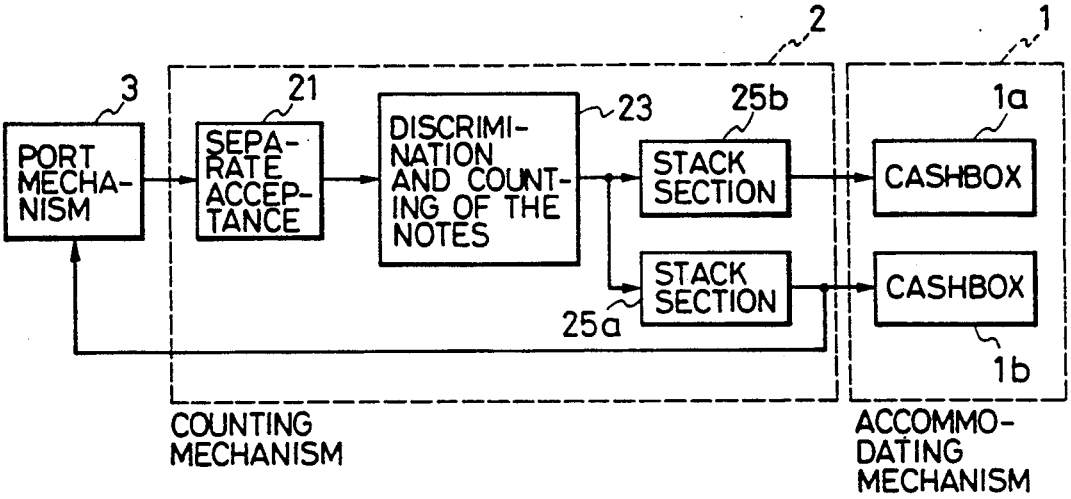
FIG. 18 shows how a note dispensing apparatus constructed in accordance with the present invention functions when it receives the money.
Figure 19:
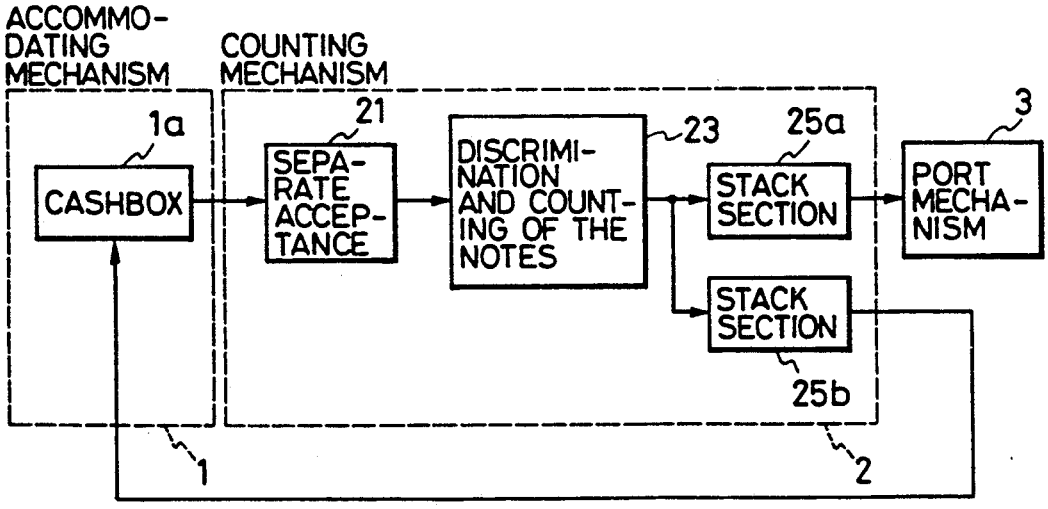
FIG. 19 shows how the note dispensing apparatus constructed in accordance with the present invention functions when it pays out money.

FIG. 18 shows the operational sequences of a deposit accepting transaction, while FIG. 19 shows those of a paying transaction. As seen from these diagrams, the cashbox 1, counting section 2, conveying section 4 and port section 3 are used in both types of transactions, thereby enabling the entire construction to be simpler and the production cost to be lower.

What is claimed is:

1. A counting apparatus for handling sheets of paper and for counting said sheets of paper, comprising:

a receiving portion for accepting and supporting in a horizontal plane said sheets of paper to be counted;

a horizontally disposed stacking portion for stacking and supporting in a horizontal plane sheets of paper conveyed from said receiving portion;

conveying means, including a conveying passage, for conveying said sheets of paper from said receiving portion to said stacking portion; and a counting and discriminating portion disposed along said conveying passage for counting and discriminating between said sheets of paper being conveyed from said receiving portion to said stacking portion;

wherein said receiving portion and said stacking portion are parallel to one another.

2. A counting apparatus for handling sheets of paper and for counting said sheets of paper, comprising:

a horizontally disposed receiving portion on one side of said counting apparatus for accepting and supporting in a horizontal plane said sheets of paper to be counted;

a horizontally disposed stacking portion on said one side for stacking and supporting in a horizontal plane sheets of paper conveyed from said receiving portion;

conveying means, including a conveying passage, for conveying said sheets of paper from said receiving portion to said stacking portion; and a counting and discriminating portion disposed along said conveying passage for counting and discriminating between said sheets of paper being conveyed from said receiving portion to said stacking portion;

wherein said receiving portion and said stacking portion are parallel to one another.

3. A counting apparatus for handling sheets of paper and for counting said sheets of paper, comprising:

a horizontally disposed receiving portion for accepting and horizontally supporting in a horizontal plane said sheets of paper to be counted;

at least two horizontally disposed stacking portions for stacking and supporting in respective horizontal planes sheets of paper conveyed from said receiving portion, each of said stacking portions forming a separate stack;

conveying means, including a conveying passage, for conveying said sheets of paper selectively from said receiving portion to said stacking portions; and a counting and discriminating portion disposed along said conveying passage for counting and discriminating between said sheets of paper being conveyed from said receiving portion to said stacking portions;

wherein said receiving portion and said stacking portions are parallel to one another.

4. A counting apparatus for handling sheets of paper according to claim 3, wherein said stacking portions form said separate stacks in parallel relation to one another.

5. A counting apparatus for handling sheets of paper according to claim 4, wherein said receiving portion has a table for accepting and supporting in the horizontal plane said sheets of paper, and wherein said table is parallel to said stacking portions.

6. A counting apparatus for handling sheets of paper according to claim 3, wherein said receiving portion and said stacking portions are disposed along a common vertical plane as said single plane.

7. A counting apparatus for handling sheets of paper according to claim 6, wherein said receiving portion has a table for accepting and horizontally supporting in the horizontal plane said sheets of paper, and wherein said table is aligned along said common vertical plane in alignment with said stacking portions.

8. A counting apparatus for handling sheets of paper and for counting said sheets of paper, comprising:

a receiving portion including a table for accepting and storing in a horizontal plane at least one sheet of paper;

a counting and discriminating portion for counting and discriminating said at least one sheet of paper received from said receiving portion;

means including a stacking section for stacking counted sheets of paper conveyed from said counting and discriminating portion to form a horizontal stack at said stack section; and said table of said receiving portion and said stack section being disposed along a single plane and in parallel relation to one another.

9. A counting apparatus for handling sheets of paper according to claim 8, wherein said means for stacking counted sheets of paper includes means for stacking each next sheet of paper conveyed from said counting and discriminating portion on top of the horizontal stack formed at said stack section.

10. A counting apparatus for handling sheets of paper according to claim 8, wherein said table of said receiving portion and said stack section are disposed along a common vertical plane.

11. A counting apparatus for handling sheets of paper and for counting said sheets of paper, comprising:

a horizontally disposed receiving portion for accepting and supporting in a horizontal plane said sheets of paper to be counted;

horizontally disposed means for stacking and supporting in a horizontal plane counted sheets of paper including means for conveying the counted sheets of paper along a loop path with respect to said receiving portion and means for forming a stack of counted sheets of paper at a stack section;

a counting and discriminating portion for counting and discriminating between said sheets of paper being conveyed from said receiving portion to said stacking means; and said receiving portion and said stack section being parallel to one another.

12. A counting apparatus for handling sheets of paper according to claim 11, wherein said receiving portion has a table for accepting and supporting in the horizontal plane said sheets of paper, and wherein one of said table and said stack section is aligned above the other.

13. A counting apparatus for handling sheets of paper according to claim 11, wherein said receiving portion and said stack section are disposed along a common vertical plane.

14. A counting apparatus for handling sheets of paper and for counting said sheets of paper, comprising:

a horizontally disposed receiving portion for accepting and storing at least one sheet of paper in a horizontal plane;

a counting and discriminating portion for counting and discriminating said at least one sheet of paper being conveyed from said receiving portion;

means for stacking counted sheets of paper including first and second horizontally disposed stack sections supporting counted sheets of paper in respective horizontal planes and first and second loop conveying passages respectively for conveying sheets of paper to said first and second stack sections;

said receiving portion and said stack sections being parallel to one another; and said counting and discriminating portion including a discriminator, a counter, and a gate that receives the result of the discriminator, and a main conveying passage for conveying sheets of paper received from said receiving portion through said discriminator and said counter to said gate such that said gate deflects the path of travel of sheets of paper discharged from said discriminator and said counter to one of said first and said second loop conveying passages n accordance with the result of the discriminator so that each one of two types of sheets of paper is stacked on a respective one of said stack sections.

15. A counting apparatus for handling sheets of paper according to claim 14, wherein said stack sections are aligned along a common vertical plane.

16. A counting apparatus for handling sheets of paper and for counting said sheets of paper, comprising:

a horizontally disposed receiving portion for accepting and horizontally supporting in a horizontal plane said sheets of paper to be counted;

a counting and discriminating portion having a discriminator, a counter and a gate, and a main conveying passage for conveying sheets of paper received form said receiving portion through said discriminator and said counter to said gate; and two horizontally disposed stacking portions for stacking in respective horizontal planes counted sheets of paper conveyed from said counting and discriminating portion, wherein each of said stacking portions has a conveying passage and said gate deflects the path of travel of counted sheets of paper to one of said stacking portion conveying passages based upon the result of the discriminator;

wherein said receiving portion and said stacking portions are parallel to one another.

17. A counting apparatus for handling sheets of paper and for counting said sheets of paper, said counting apparatus having a front end, comprising:

an entrance for accepting sheets of paper inside the counting apparatus;

an exit for releasing sheets of paper outside the counting apparatus;

a horizontal hopper disposed close by said entrance, for accepting and piling in a horizontal plane at least one sheet of paper;

a counting and discriminating portion for counting and discriminating said at least one sheet of paper from said hopper;

a horizontal stacker disposed close by said exit, for piling in a horizontal plane counted sheets of paper received from said counting and discriminating portion;

a conveying means for conveying sheets of paper one by one from said hopper to said stacker through said counting and discriminating portion; and said entrance and said exit being parallel to one another.

18. A counting apparatus as claimed in claim 17, wherein said entrance and exit represent two points forming a line extending across the front end of said counting apparatus.

19. A counting apparatus for handling sheets of paper and for counting said sheets of paper, said counting apparatus having a front end, comprising:

an entrance for accepting sheets of paper into the counting apparatus;

an exit for releasing sheets of paper out of the counting apparatus;

a horizontal hopper disposed close to said entrance, for accepting and piling at least one sheet of paper to be counted in a horizontal plane;

a horizontal stacker disposed close to said exit, for piling in a horizontal plane counted sheets of paper received from said counting and discriminating portion;

a conveying line means for conveying sheets of paper one by one from said hopper to said stacker;

a counting and discriminating portion disposed in said conveying line means, for counting and discriminating between said sheets of paper; and said entrance and exit being disposed vertically and parallel to one another at the front end of said counting apparatus.

* * * * *